US007243590B2

(12) United States Patent
McClellan et al.

(10) Patent No.: US 7,243,590 B2
(45) Date of Patent: Jul. 17, 2007

(54) PROTECTIVE BALLISTIC WEAPONS STANDS AND TRANSPARENT SHIELDS USEABLE THEREWITH

(75) Inventors: Dale A. McClellan, Virginia Beach, VA (US); Alfred R. Clark, Virginia Beach, VA (US)

(73) Assignee: STS Security Products, LLC, Virginia Beach, VA (US)

( * ) Notice: Subject to any disclaimer, the term of this patent is extended or adjusted under 35 U.S.C. 154(b) by 29 days.

(21) Appl. No.: 11/114,232

(22) Filed: Apr. 26, 2005

(65) Prior Publication Data

US 2007/0131103 A1 Jun. 14, 2007

Related U.S. Application Data

(63) Continuation-in-part of application No. 10/445,776, filed on May 27, 2003, now Pat. No. 7,051,637.

(51) Int. Cl.
*F41H 5/013* (2006.01)

(52) U.S. Cl. ..... 89/36.06

(58) Field of Classification Search ..... 89/36.01, 89/36.04, 36.05, 36.07, 36.12, 36.13, 36.14, 89/36.16; 109/49.5, 58.5
See application file for complete search history.

(56) References Cited

U.S. PATENT DOCUMENTS

| | | | | |
|---|---|---|---|---|
| 295,013 | A | 3/1884 | Hunter | |
| 774,223 | A | 11/1904 | Wilson | |
| 811,715 | A * | 2/1906 | Hadfield et al. | 109/49.5 |
| 1,146,428 | A | 7/1915 | Jacob | |
| 1,290,606 | A | 1/1919 | Lovas | |
| 1,297,618 | A * | 3/1919 | Werbowetzki | 160/219 |
| 1,301,293 | A | 4/1919 | Molvig | |
| 1,323,433 | A | 12/1919 | Alexander | |
| 1,555,027 | A | 9/1925 | Rose | |
| 1,611,814 | A | 12/1926 | Butler | |
| 1,928,306 | A * | 9/1933 | Brennan | 89/36.08 |
| 2,215,204 | A | 9/1940 | Young | |
| 2,306,708 | A | 12/1942 | Mendel | |
| 2,324,503 | A * | 7/1943 | Herrington | 109/58.5 |
| 3,369,836 | A * | 2/1968 | Haycock et al. | 296/78.1 |

(Continued)

*Primary Examiner*—Michael J. Carone
*Assistant Examiner*—Bret Hayes
(74) *Attorney, Agent, or Firm*—Millen, White, Zelano & Branigan, P.C.

(57) ABSTRACT

A ballistic weapon stand has a base plate for mounting armor panels having front and rear faces. The armor panels are fastened to and extend upwardly from the base at an angle in the range of 10–30° with respect to the vertical to define a protected space behind the panels. Struts are welded to the base plate and extend upwardly toward and through an opening in a middle armor panel and between the edges of the middle armor panel and side armor panels. Welding plates are constructed and arranged for welding to the struts on the rear faces of the armor plates. The welding plates extend over the rear faces of the armor plates at junctions between the armor plates. A weapon platform is disposed on a second portion of at least one of the struts for mounting a weapon in the protected space to fire out past the front face of the armor panels. A transparent projectile defeating shield is mounted to swivel with the weapon, preferably on the weapons stand. The transparent shield may have one-way visibility so that a gunner is not visible to adversaries, but adversaries are visible to the gunner.

5 Claims, 16 Drawing Sheets

U.S. PATENT DOCUMENTS 4,358,984 A 11/1982 Winblad
4,412,495 A 11/1983 Sankar
4,497,515 A 2/1985 Appelson
4,643,477 A * 2/1987 Kovatch ..... 296/96.21
4,673,609 A 6/1987 Hill
4,674,394 A 6/1987 Martino
4,812,031 A 3/1989 Evans
5,293,807 A * 3/1994 Hajdu ..... 89/36.07
5,747,159 A * 5/1998 Labock ..... 428/335
5,767,933 A 6/1998 Hagan
5,773,110 A 6/1998 Shields
5,862,882 A * 1/1999 Brady et al. ..... 182/129
5,925,437 A 7/1999 Nelson
5,936,550 A 8/1999 McCauley
6,030,687 A 2/2000 Andriash
6,133,856 A 10/2000 McCauley
6,401,427 B1 * 6/2002 Snyder ..... 52/764
6,487,807 B1 12/2002 Kopman et al.
6,595,101 B2 * 7/2003 Baker ..... 89/36.05
6,872,435 B2 3/2005 Bull et al.
7,124,675 B1 * 10/2006 Sand ..... 89/36.07
2005/0188596 A1 9/2005 Wugant
2005/0188597 A1 9/2005 Keng et al.
2005/0217472 A1 10/2005 Baker
2006/0086242 A1 4/2006 Clark et al.

* cited by examiner

PROTECTIVE BALLISTIC WEAPONS STANDS AND TRANSPARENT SHIELDS USEABLE THEREWITH

RELATED PATENT APPLICATIONS

This application is a continuation-in-part of U.S. patent application Ser. No. 10/445,776, filed May 27, 2003 now U.S. Pat. No. 7,051,637 for "Modular Armor Shield Assembly" which is and incorporated herein in its entirety.

U.S. Design Patent Application to "Transparent Projectile Defeating Shield", filed on even date and incorporated herein in its entirety by reference.

FIELD OF THE INVENTION

The present invention relates to protective ballistic weapon stands and to transparent shields useable therewith, the shields being either in combination with the stands or separate therefrom. More particularly, the present invention relates to protective ballistic weapon stands that are used for fixed weapon emplacements on ships, vehicles, air-supported vehicles, and at stationary locations (such as but not limited to entry control points and fighting positions). Moreover, the invention relates to transparent shields that are useable with fixed weapon emplacements on vehicles, ships and at stationary locations.

BACKGROUND OF THE INVENTION

Soldiers, sailors, marines and security personnel operating fixed weapon emplacements which may include weapons, such as but not limited to: the M2HB .50 caliber Machine Gun, MK43 Mod 1 7.62 mm Machine Gun, M240 7.62 mm Machine Gun, M249 5.56 mm Machine Gun, MK48, MK46 weapons, or to weapon mounts and cradles to include but not be limited to the MK16 stand, MK82, MK93, MK95, MK97 and MK125 and to all modifications related to these types of stands and cradles. Positions including these and other weapons may all be exposed to incoming bullets and shrapnel. It is desirable to shield these gunners from incoming fire with minimal compromise to their effectiveness. Currently, most shields are opaque and therefore limit the operator's vision and protection so that while offering protection, the shields also expose gunners and adjacent personnel to fire from sources screened by the opaque shields themselves.

While transparent shields are currently being offered for possible purchase, such shields tend to be very heavy and tend to restrict gun elevation. Adequate gun elevation is necessary for urban combat situations requiring extreme elevation and depression. Moreover, these transparent shields tend to have integral armor skirts which limit visibility in situations where the operator is confronted by threats which occur from below an emplacement, for example, blow emplacements on piers or on the sides, bows and stems of ships. In addition, it is desirable to have transparent shields which may be rapidly retrofitted to existing weapon emplacements and are of minimal weight so that transport, rapid mounting and replacement of transparent shields is facilitated.

There is a need for protective ballistic weapon stands used for fixed weapon emplacements, wherein the ballistic stands protect gunners from incoming bullets and shrapnel while providing support for a weapon or a number of weapons, and wherein the weapon emplacements optionally include transparent shields mounted for cooperation with the protective ballistic weapon stands.

In view of these and other limitations, there is a need for effective transparent shields which retrofit readily to existing emplacements, whether stationary or on vehicles or ships, which transparent shields are minimal in weight without compromising protection provided by the transparent shields.

SUMMARY OF THE INVENTION

A ballistic weapon stand comprises a base for mounting the ballistic weapon stand and an armor panel arrangement having a front face and a rear face. The armor panel arrangement is fastened to and extends upwardly from the base at an angle in the range of 10–30° with respect to the vertical to provide a protected space to the rear of the armor panel arrangement which is defined by an obtuse slant of the rear face of the armor panel. A projectile deflection space provided in front of the armor panel and is defined by an acute slant of the front face of the armor panel. A strut is fixed to the base and extends upwardly toward and through an opening in the armor panel arrangement. The strut has a first portion of a dimension greater than a corresponding dimension of the opening providing a support surface for engaging the front face of the armor panel. The strut has a second portion that extends through the opening and past the rear face of the armor panel. A welding plate is disposed on the back face of the armor panel arrangement over the opening therethrough. The welding plate is constructed and arranged for welding to the second portion of the strut. A weapon platform is disposed on the second portion of the strut for mounting a weapon in the protected space to fire out past the front face of the armor panel arrangement.

In another aspect of the ballistic weapon stand, the armor panel arrangement includes at least two armor panels optionally at an angle to one another to form a concave projectile space and a convex projectile deflecting surface.

In another aspect of the ballistic weapon stand, the armor panel arrangement comprises three armor panels.

In another aspect of the ballistic weapons stand there is a middle armor panel and two side panels adjacent the middle armor panel. The middle armor panel has no welds on the face thereof and no welds on the side edges thereof. A first strut extending through a slot in the middle armor panel engages the front face of the middle armor panel and has a portion extending through the slot to provide a platform for supporting a weapon behind the middle armor panel. The two side panels have side edges welded, preferably with stitch welds, to struts extending between the edges of the middle armor panel and the side edges, with the edges of the middle armor panel being unwelded. Armor plates are welded to welding straps that overlie the seams between the middle and side plates, also preferably with stitch welds which are preferably spaced. A welding strap is also welded to the first strut on the back side of the middle panel.

In a further aspect of the ballistic weapon stand, a transparent projectile defeating shield is mounted to swivel with the weapon.

In a further aspect of the transparent shield has one-way visibility so that a gunner is not visible to an adversary, but the adversary is visible to the gunner.

In another aspect of the invention, a projectile defeating transparent shield, has a base plate of armored material, the base plate having a slot therein for accommodating a barrel of a weapon and having an arrangement proximate the slot for attaching the base plate adjacent to the weapon. Openings are provided through the base plate and are positioned laterally of the slot on opposite sides of the slot. A panel arrangement of projectile defeating transparent material overlies the openings, the transparent material being resistant to penetration by bullets and shrapnel. A box frame arrangement is attached to the base plate in nesting relationship with the panel arrangement and peripherally overlies the panel arrangement to hold the panel arrangement in fixed relation over the openings through the base plate. The box frame arrangement is substantially lighter in weight than the base plate.

In a further aspect, there are two transparent panels of projectile defeating transparent material with the box frame arrangement comprising a two box frames, each nesting a transparent panel.

In still a further arrangement, the transparent panel arrangement conceals a gunner behind the panel while transmitting images to the gunner of what is in front of the panel.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
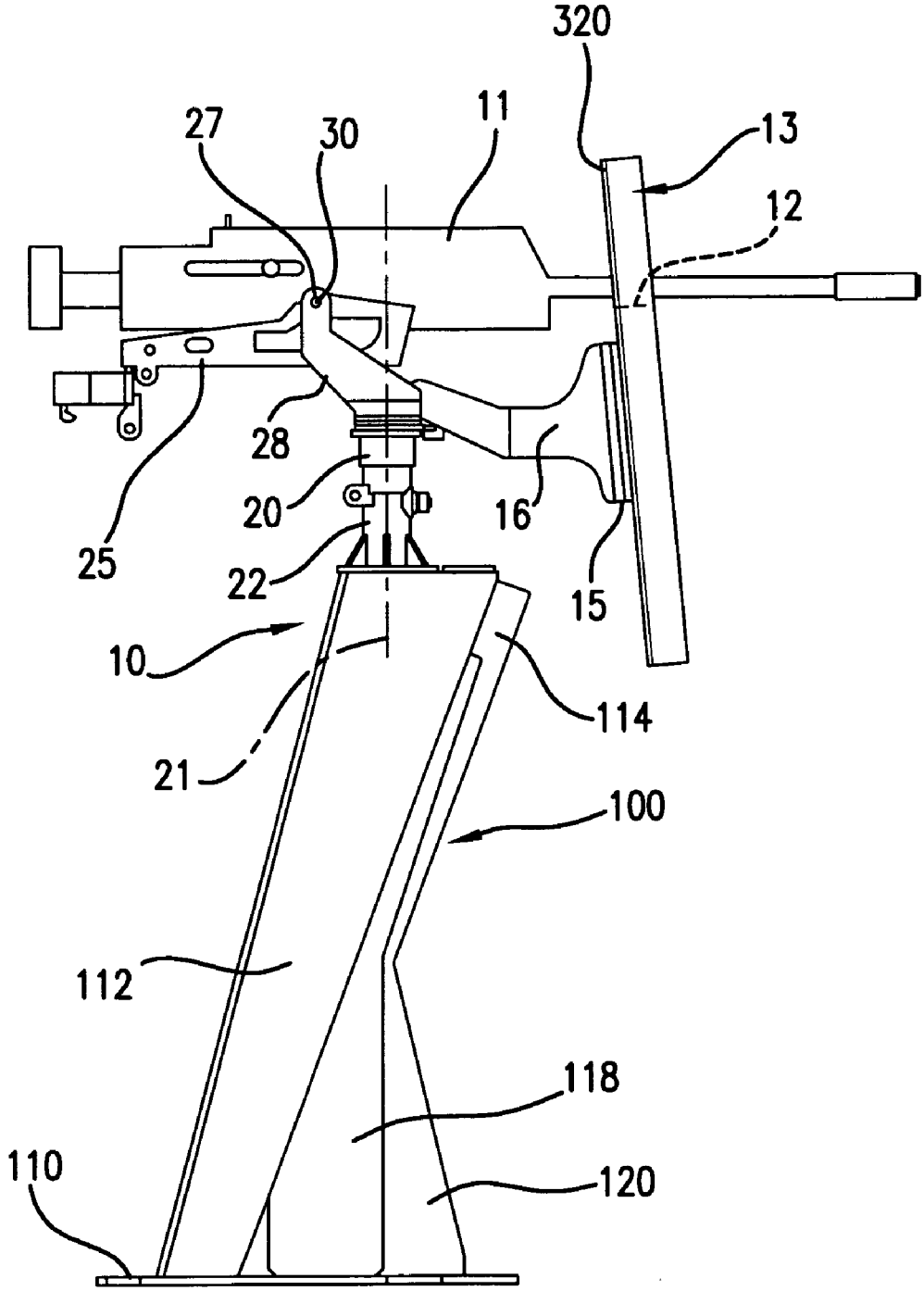
FIG. 1 is a side view of a fixed weapon emplacement in combination with a transparent shield.

Referring to FIG. 1, there is shown a fixed weapon emplacement 10 having a weapon such as a gun 11 mounted thereon that projects through a slot 12 in a transparent shield 13. The transparent shield 13 is made of a transparent material capable of defeating projectiles such as bullets or shrapnel which might otherwise wound or kill a gunner standing behind the shield. The transparent shield 13 enables a gunner to see through the shield while protecting him from incoming fire. The transparent shield 13 comprises at least one panel of projectile-resistant material, such as but not limited to, projectile-resistant glass in the form of a laminate comprising glass, polycarbonate and polyurethane. In one embodiment this, glass is chemically treated and works properly when installed in one direction.

Figure 2A:
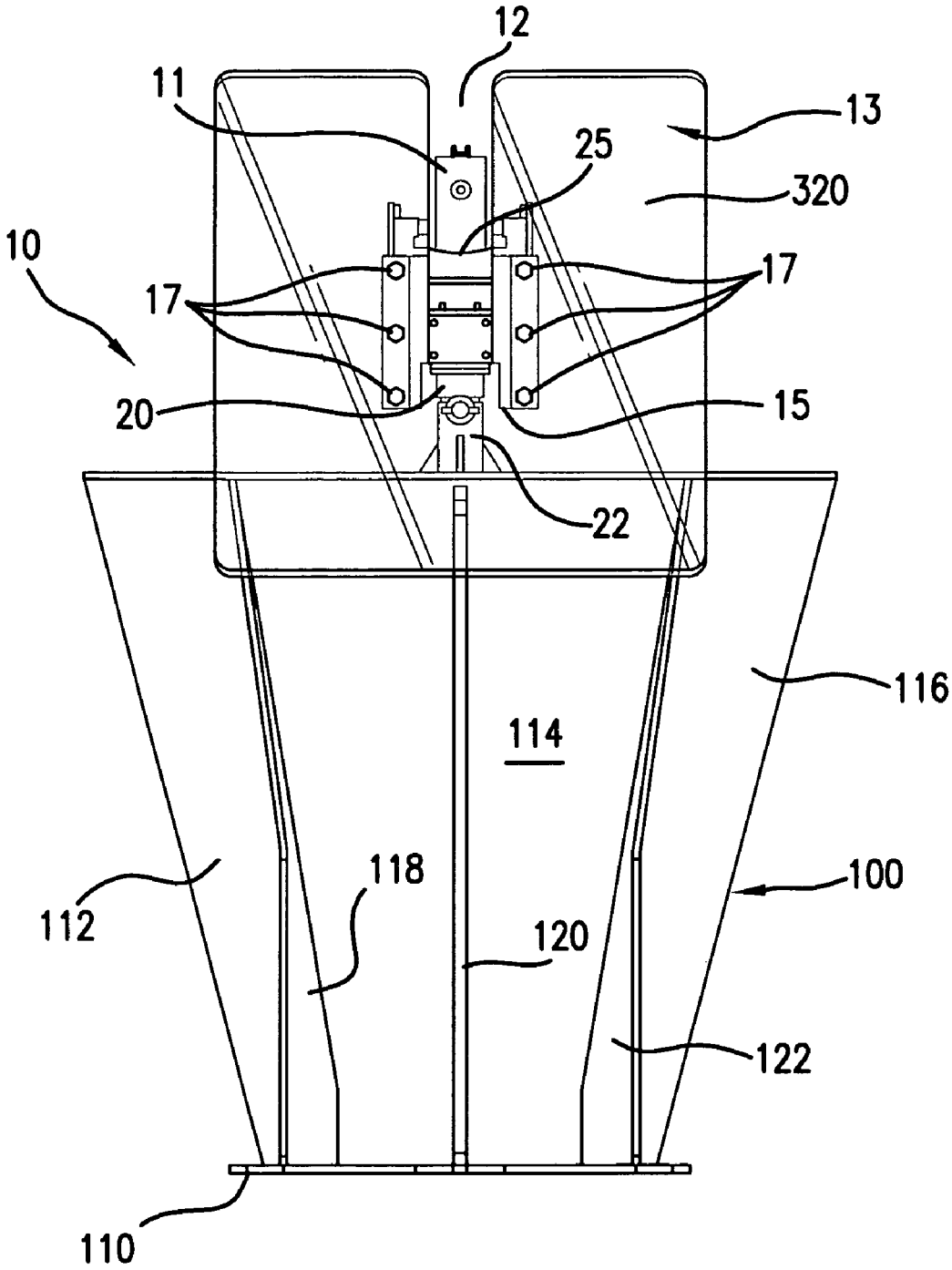
FIG. 2A is a front view of a portion of the fixed weapon emplacement of FIG. 1.

Referring now to FIG. 2A in combination with FIG. 1, the transparent shield 13 is mounted on the front end 15 of a mounting bracket 16 by an array of bolts 17. While an array of bolts 17 is a preferred mounting approach, other attachment arrangements may be utilized such as, but not limited to, a pair of receiving slots with latches (not shown). Since the transparent shield 13 may be damaged or blurred by ballistic impacts, it is important that the shield be attached in a manner so that it may be conveniently replaced. The bolts 17 provide that convenience. In order to protect the transparent shield 13 from elements and to conceal its nature from an assailant perhaps not familiar with its construction, a breakaway cover is provided.

Figure 4:
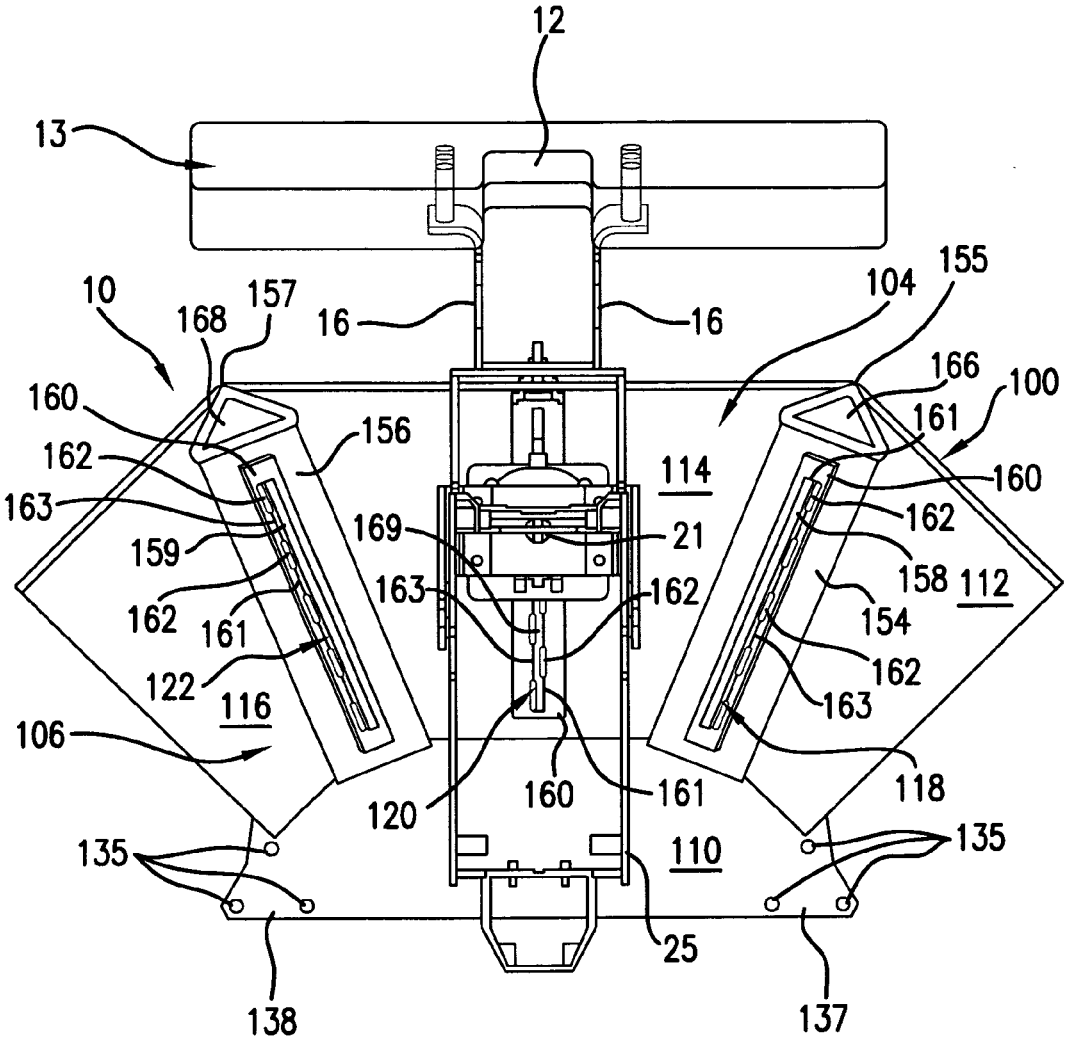
FIG. 4 is a top view of the fixed weapon emplacement of FIGS. 1–3.
Figure 5:
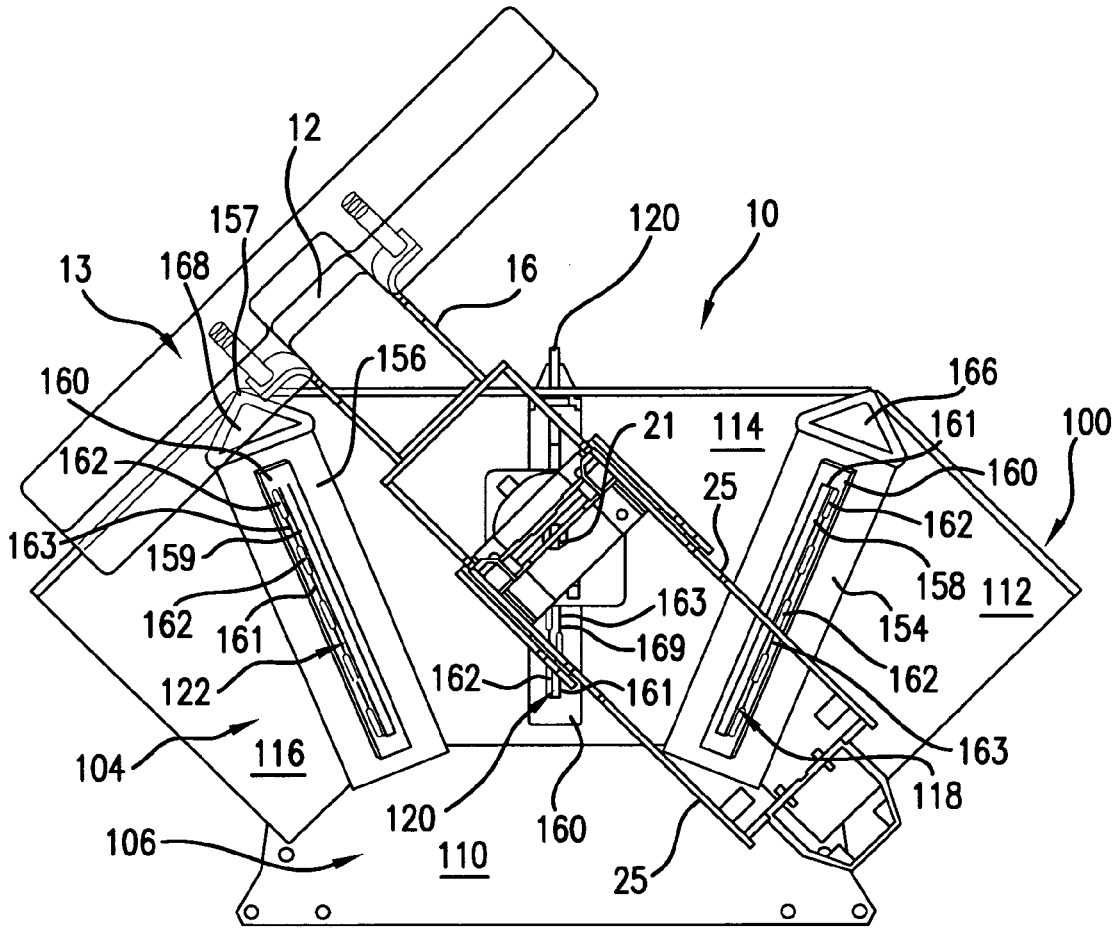
FIG. 5 is a top view similar to FIG. 4, but showing the transparent shield pivoted with a gun carriage to an angularly-displaced position.

As is best seen in FIGS. 1 and 3, the bracket 16 is rigidly fixed to a swivel 20 that is mounted to pivot about a vertical axis 21 on a stand 22. Consequently, the transparent shield 13 may swivel with the gun 11 from, for example, the FIG. 4 position to the FIG. 5 position, as well as to other angular positions about the vertical axis 21. When it is necessary to elevate the gun 11, the transparent shield 13 remains fixed with respect to the vertical and the gun 11 elevates and lowers within the slot 12. Elevation of the gun 11 is accomplished by a gun cradle 25 which mounts the gun on the swivel 20 to pivot the gun about a horizontal axis 27. The swivel 20 has a pair of flanges 28 that project upwardly therefrom and which receive pivots 30 coaxial with the axis 27. The pair of flanges 28, swivel 20 and mounting bracket 16 pivot in unison about the axis 27 so that the weapon sweeps with relative ease. The transparent shield 12 is relatively lightweight so that any inertial interference with aiming the gun 11 is minimized. The gun 11 is also substantially balanced at the axis 27, allowing the gunner easily to elevate the gun 11 in the slot 12, independently of the sweep position of the gun and shield 13.

Figure 6A:
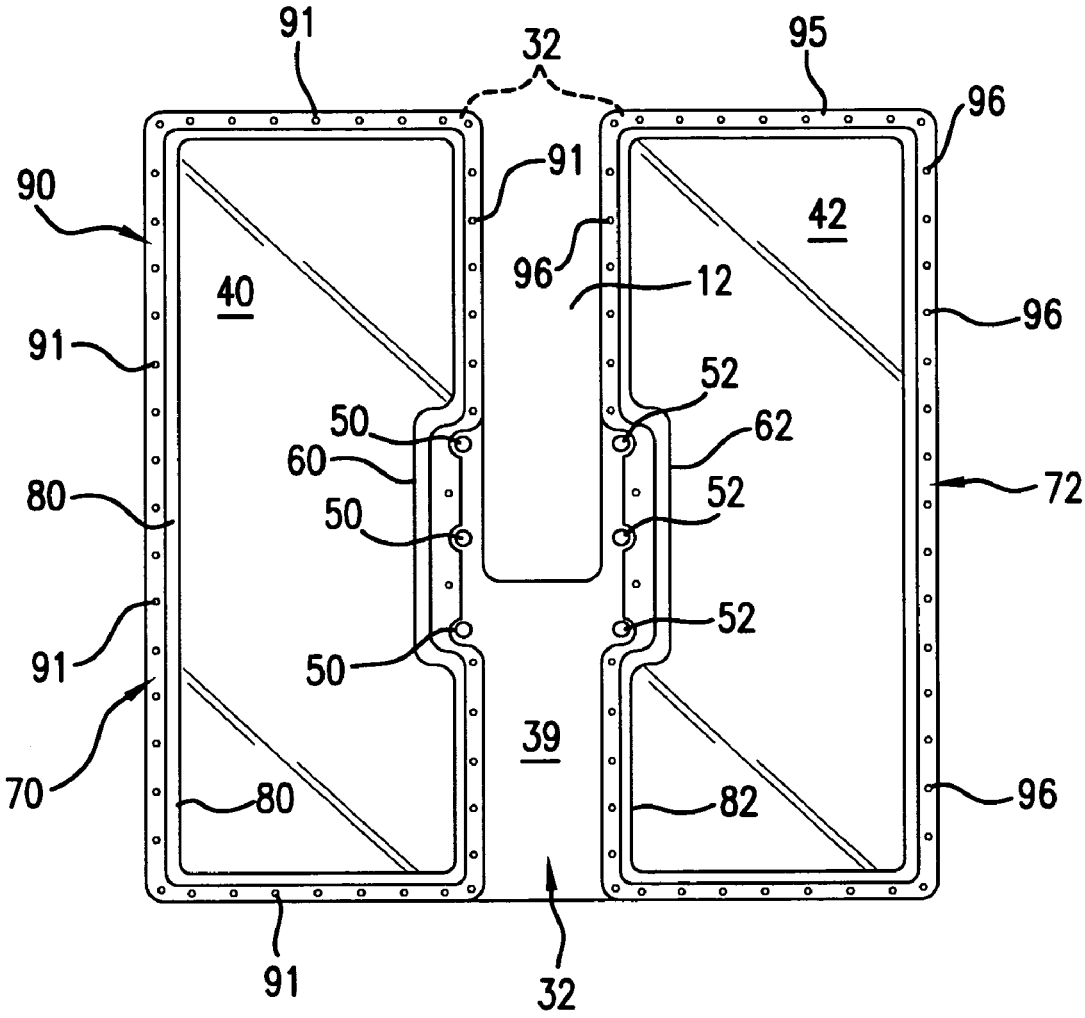
FIG. 6A is a planar front view of a transparent shield.
Figure 6B:
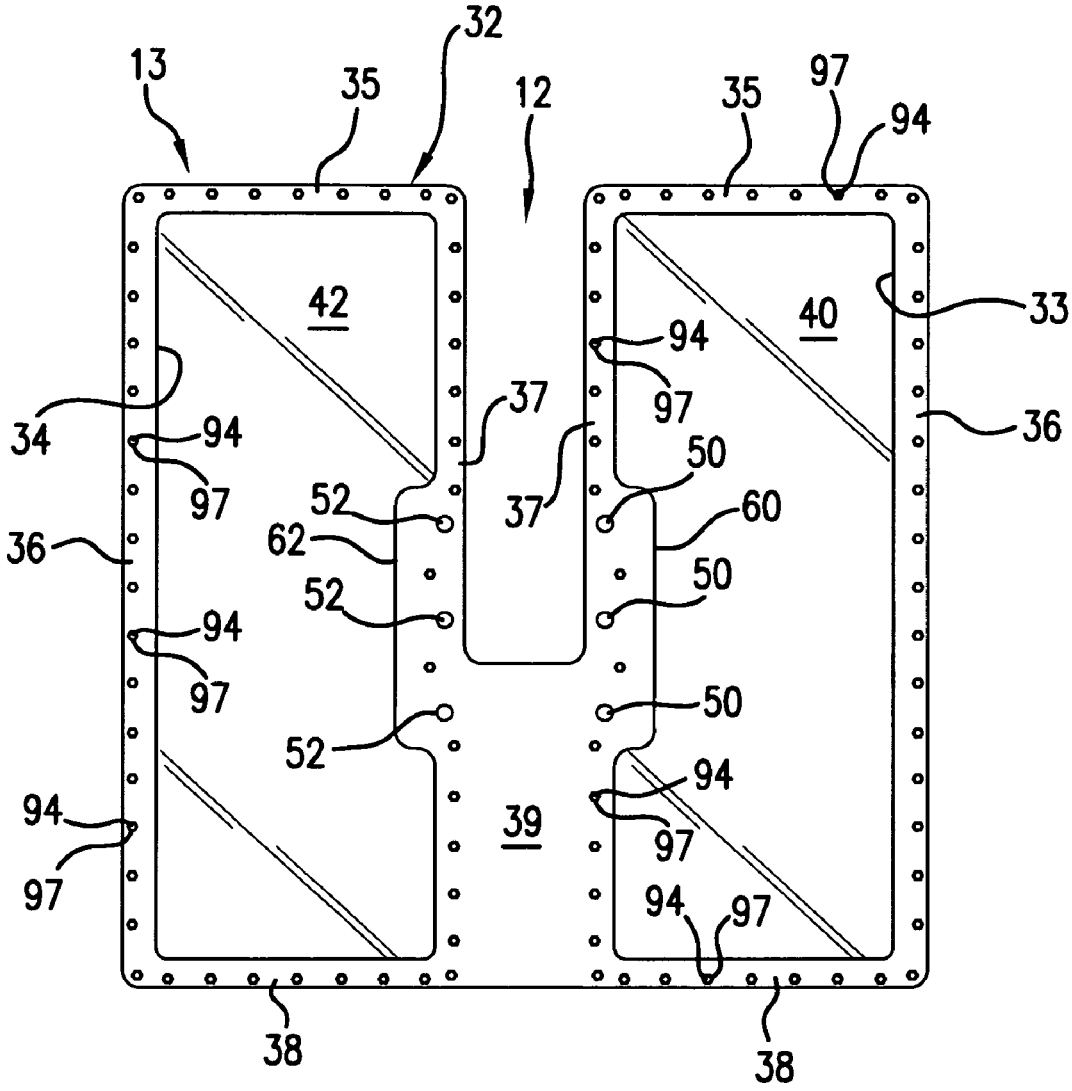
FIG. 6B is a planar back view of the transparent shield on FIG. 6A.
Figure 7A:
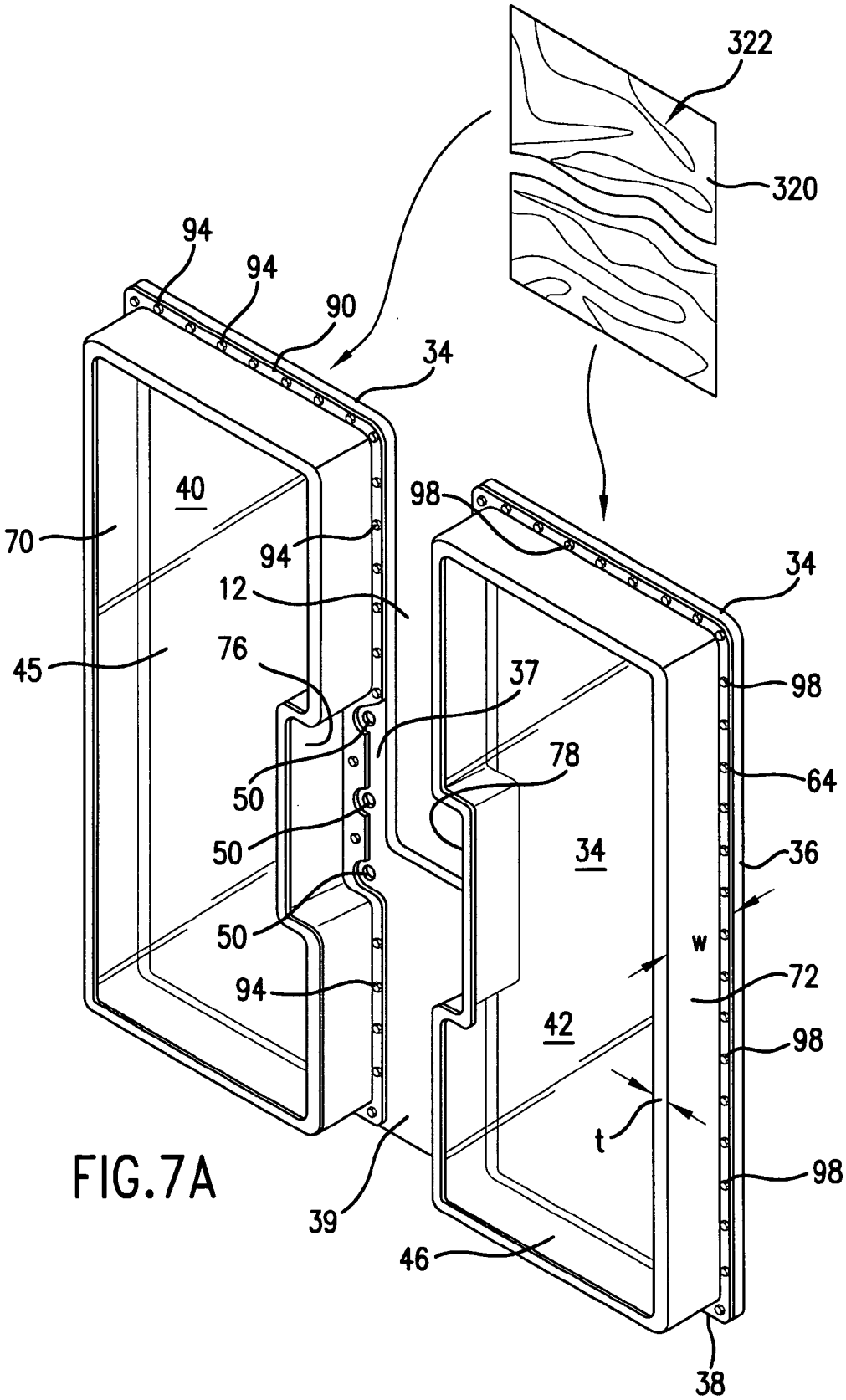
FIG. 7A is a front perspective view of the transparent shield of FIG. 6.
Figure 7B:
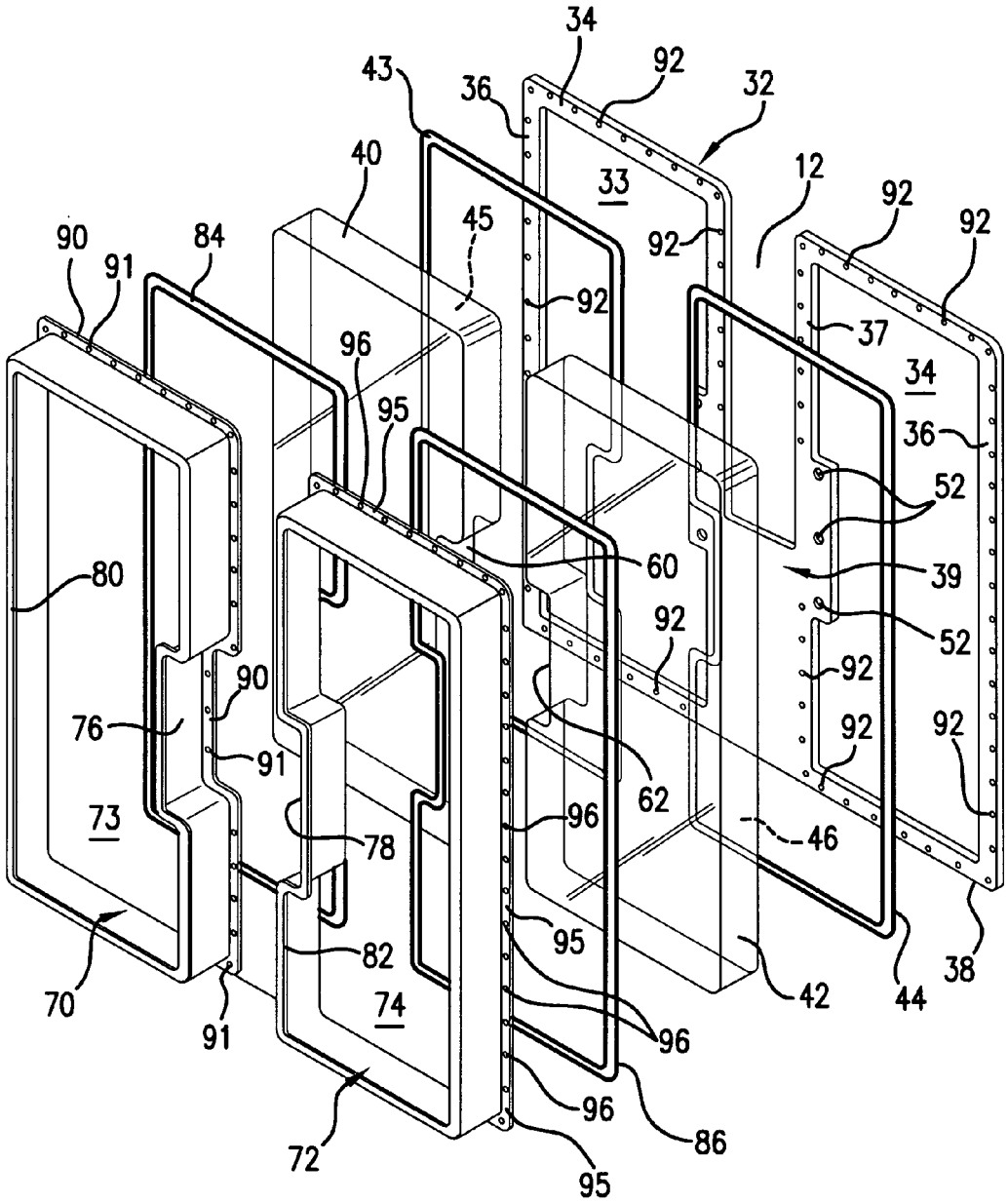
FIG. 7B is an exploded front view of a transparent shield of FIGS. 6A, 6B and 7A.

Referring now to FIGS. 6A, 6B, 7A and 7B, a preferred embodiment of the transparent shield 13 is shown in FIG. 6A from the assailant's perspective and in FIG. 6B from the gunner's perspective. As is seen in FIG. 6B, the armored base 32 has first and second openings 33 and 34 therein. The openings 33 and 34 are each defined by a top portion 35 and an outside portion 36, an inside portion 37 and a bottom portion 38 of the armored base 32. A central portion 39 of the armored base 32 extends between the inside portions 37 beneath the slot 12 through which the barrel of gun 11 passes (see FIGS. 1 and 2). First and second transparent panels 40 and 42 of projectile-resistant material overlie the openings 33 and 34 and, as is seen in FIG. 7B, abut against peripheral gaskets 43 and 44 that surround the openings 33 and 34, respectively. The first and second armored base 32 and transparent panels 40 and 42 provide protection to the gunner positioned behind the armored base 32 and rear surfaces 45 and 46 of the first and second armored shields 40 and 42, respectively.

A first row of three bolt holes 50 are located adjacent to the first opening 33 through the left inside portion 37 of the armored base 32. A second row of three bolt holes 52 are located adjacent to the second opening 34 of the armored base 32 and extend through the right inside portion 37 of the armored base. As is seen in FIG. 2, bolts 17 extend through the bolt holes 50 and 52 to attach the armored base 32 to the flange 15 on the bracket 16 that attaches the transparent shield to the swivel 20.

According to a preferred embodiment, the armored base 32 is steel AR500 wear armor plate that is about ⅜ inch thick. According to a preferred embodiment, the first and second transparent panels 40 and 42 are preferably made from NIJLEVEL IV or UL LEVEL 8 rated, projectile resistant, glass-polymer laminate which is sufficient to provide ball protection in the range of 5 to 10 mm, preferably at least 7.62 mm. Other projectile-resistant and bulletproof materials and arrangements may be used. A preferable projectile resistant, transparent material is available from Sully North America of Trumbauersville, Pa. 18970 having the name, "Spectacserv 41 mm Ballistic Shield" and listed under products for STS Security Products, LLC. This transparent panel material is a laminate of glass, polycarbonate and polyurethane. According to a preferred embodiment, the transparent panels 40 and 42 each weigh about 27 lbs. (54 lbs. together), are about 9 inches wide and about 25 inches high, with a thickness in a range of about 1.5 to 1.8 inches. The transparent panels 40 and 42 have elongated notches 60 and 62 to provide clearance for the rows of bolt holes 50 and 52 in the armored base. The total weight of the transparent shield 13 is about 92 lbs.

As is best seen in FIGS. 7A and 7B, the transparent panels 40 and 42 are retained on the armored base 32 by first and second box frames 70 and 72, respectively. The box frames 70 and 72 define openings 73 and 74 which complement the shape of the transparent panels 33 and 34. The box frames include elongated notches 76 and 78 that provide access to nuts for bolts 17 (See FIG. 2) that extend through the holes 50 and 52 in the armored base 32. The box frames 70 and 72 are of substantially lighter material than the armored base 32 and, for example, are made of 11 or 14 gauge steel.

In order to retain the transparent panels 40 and 42 within the box frames 70 and 72, the box frames have flanges 80 and 82 against which the transparent panels 40 and 42 are seated. Second gaskets 84 and 86 (FIG. 7B) are disposed between the flanges 80 and 82 and the transparent panels 40 and 42 to ensure a tight fit.

The first box frame 70 has a peripheral flange 90 with bolt holes 91 which align with bolt holes 92 in the armored base 32 (See FIG. 7B). The first box frame 70 secures the first transparent panel 40 to the armored base over the opening 33 with bolts 94. The second box frame 72 has a flange 95 with bolt holes 96 aligned with the bolt holes 92 in the armored base 32. The second box frame 72 is secured to the armored base 32 with the bolts 94. As is seen in FIG. 6B, the bolts 94 are retained by nuts 97, preferably hex nuts.

While more nuts and bolts 94, 97 are shown in FIG. 6B, a preferred embodiment has eight nuts and bolts on the outside portions 36, three nuts and bolts on the top side portions 35, three nuts and bolts on the bottom side portions 38 adjacent to the window 42 and three nuts and bolts on the bottom side portion adjacent to window 42. In addition there are three nuts and bolts on the inside portions 37 above the bolt holes 50 and 52 and two nuts and bolts below the bolt holes 50 and 52 (see copending design patent application "Projectile Defeating Shield" filed on even date.)

While steel which tempered to armored steel specifications is the preferred material for the armored base 32, other materials such as titanium, various carbon based components, or other strong impact resistant materials may be used.

The transparent panels 40 and 42 are nested in the box frames 44 and 46 on the gaskets 84 and 86, respectively, which abut the front or incoming fire sides 90 and 91 of the transparent panels 40 and 42. The stop frame 62 bares against the gaskets 43 and 44 which abut the rear surfaces 45 and 46 of the transparent panels 40 and 42.

The fixed weapon emplacement 10 discussed thus far with respect to FIGS. 1–5 also comprises a ballistic weapon stand 100 shown in FIGS. 1–5, as well as in FIGS. 8–13. The ballistic weapon stand 100 optionally includes the transparent shield 13 in combination therewith. The ballistic weapons stand 100 has a front area 102 which faces assailants and a rear area 104 which faces a protected space 106. The ballistics stand 100 includes a base 110 having an array of armor panels 112, 114 and 116 which are welded to the base and extend therefrom at an angle in the range of 10° to 30°, and preferably about 20°, with respect to the vertical so as to deflect bullets and shrapnel downwardly toward the base and whatever platform to which the base is secured. The armor panels 112–116 are made of AR500 Lear armor plate steel or armor plate tempered to military specifications. The base 110 may be located at an anti-terrorism or force protection location, at a fighting position, or installed at an entry control point, or the base may be secured on the deck of a ship, which could be any type of ship including a relatively small patrol boat. Another location which the ballistic weapon stand 100 is used are guard towers located around guard shacks.

In order to stiffen the armor panels 112–114, vertically extending struts 118, 120 and 122 are welded to and extend upwardly from the base 110. The struts 118, 120 and 122 are preferably made of armored steel, such as but not limited to, a steel such as AR500 armor plate. The first strut 120 projects through a laser cut slot 123 back into the projected space 106 of the ballistic weapons stand 110. The first strut 120 has a dimension in front of the slot 123 which is greater than the slot 123 so than only a rear portion 169 (see paragraph [048] projects through the slot 123. The armor panel is braced at its front surface. The slot 123 could be formed in other ways, such as but not limited to, casting. It is only important that forming of the slot not degrade the temper of the armor panel.

Figure 2B:
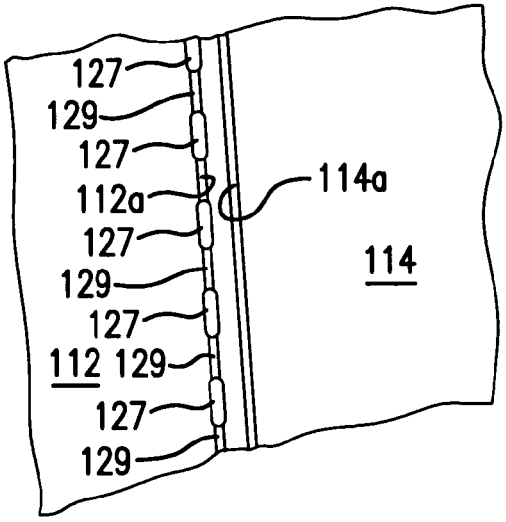
FIG. 2B is a front view of a portion of the left side of the fixed weapon emplacement of FIG. 2A showing a welding arrangement.
Figure 2C:
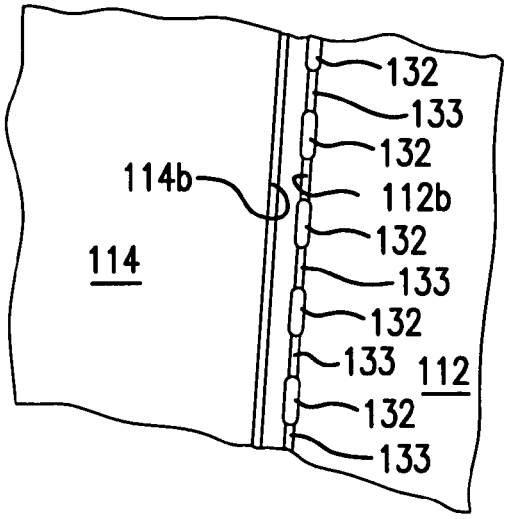
FIG. 2C is a front view of the right side of the fixed weapon emplacement of FIG. 2A showing a welding arrangement.

As is seen primarily in FIGS. 2A, 2B and 2C, in order to minimize degradation to the ballistic integrity of the panels 114, 116 and 118, there are no welds on the faces of the panels. As is seen in FIG. 2B, the edge 114*a* of panel 114 is unwelded, while the edge 112*a* of the armor panel 112 is welded with stitch welds 127 to the side 118*b* of the first strut 118. The stitch welds 127 have gaps 129 therebetween. Likewise, as is seen in FIG. 2C, the edge 114*b* of the armor panel 114 unwelded, while the edge 116*a* of the panel 116 is welded by stitch welds 132 having gaps 133 therebetween to the side 122*b* of the third strut 122. This arrangement provides vertical support for the armor panels 112, 114 and 116 of the ballistic weapons stand 100 on the base 110 without having welds on the front or rear faces or the edges 114*a* and 114*b* of armor panel 114. Only the edges 112*a* of armor panel 112 and 116*a* of armor panel 116 have welds and these are preferably stitch welds with gaps that minimize and localize changes in temper to the armor panels 112 and 116.

The base 110 has holes 135 therein for receiving bolts to anchor the base to a support on the ground, building platform or ship deck. At least some of the holes 135 are located in triangular projections 136, 137 and 138 at the front and rear edges of the base. This anchors the ballistic weapons stand 110 out board of the lower periphery thereof as defined by the lower edges of the armor panels 112, 114 and 116. The base is also anchored by bolts through holes 135 within the protected space 150 shielded by the armor panels 112, 114 and 116. The bottom edges of the armor panels 112, 114 and 116 are attached, preferably by welding to the base 110. Interference with temper is this limited to small edge portions of the armor panels 112, 114 and 116. Other methods, such as mechanical interlocking or bolting may be utilized but welding is preferred.

Referring now to drawing Figs. such as FIGS. 3A–4, 5, 8 and 10, wherein the protected space 106 behind the armor panels 112, 114 and 116 is shown, it is seen that a backing plate 154 abuts armor panels 112 and 114 to cover the seam 155 between the armor panels 112 and 114 and a backing plate 156 abuts armor panels 116 and 114 to cover seam 157. The backing plate 154 has a slot 154*a* therein which receives a rear portion 158 of the strut 118 therethrough, while the backing plate 156 has a slot 156*a* that receives a rear portion 159 of the strut 122 therethrough. The backing plates 154 and 156 are also made of armor plate steel and provide back-up armor to the seams 155 and 157 which are formed by the stitch welds 126 and 130 (See FIGS. 2A, 2B and 2C) and to adjacent edge portions 112*a* and 116*a* of the armor panels 112 and 116 which have had changes in temper due to welding. A welding strap 160 with a slot 161 therethrough is placed over backing plate 154 and receives a rear portion 158 of strut 118 (FIG. 2A) therethrough. Spaced stitch welds 162 with gaps 163 therebetween weld the rear portion 158 to the welding strap 160. A similar weld strap 160 with a slot 161 overlies the backing plate 156 with a rear portion 159 of the gusset 122 (See FIG. 2A) projecting therethrough. Spaced stitch welds 162 with gaps 163 therebetween also weld the rear portion 159 to the welding strap 160. In this way, the backing plates 154 and 156 covering the seams 155 and 157 have no welds along their length and provide full hardness temper armor behind the seams 155 and 157. The spaced stitch welds 162 with gaps 163 are staggered with respect to one another on opposite sides of the portions 158 and 159.

At the top of each of the backing plates 154 and 157, there may optionally be triangular fillers 166 and 168, respectively, which are welded around the edges thereof to the armor panels 112 and 114 and to the armor panels 116 and 114. Since these welds are adjacent to the top edges of the armor panels and the backing plates, temper is changed in only a very small area of armor. A third welding strap 160 with a slot 161 therein receives therethrough a rear portion 169 of the strut 120 which projects through the laser cut slot 124 in the panel 114 and is also welded with stitch welds 162, having gaps 163 therebetween, to the rear portion 169 of the gusset 129. The gusset 120 also has a triangular projection 172 unitary therewith which supports the weapon 11. As is evident from the Figures, the triangular projection 172 passes through the laser cut slot 123 in the middle panel 114. By this arrangement, there are no welds in the middle armor panel 114 which might compromise the temper of the middle armor panel. Optionally, an armored backing plate, such as the armored backing plates 154 and 156 may also be placed behind the slot 123 between the middle panel 114 and the third welding plate 160, but this is not thought necessary because the laser cut is not thought to substantially alter the temper of the armor plate 114.

Figure 3B:
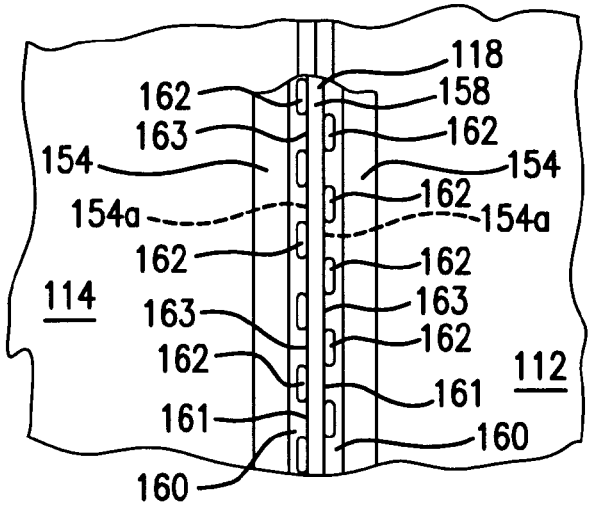
FIG. 3B is a portion of FIG. 3A with portions broken away to show details of a welding arrangement.
Figure 3A:
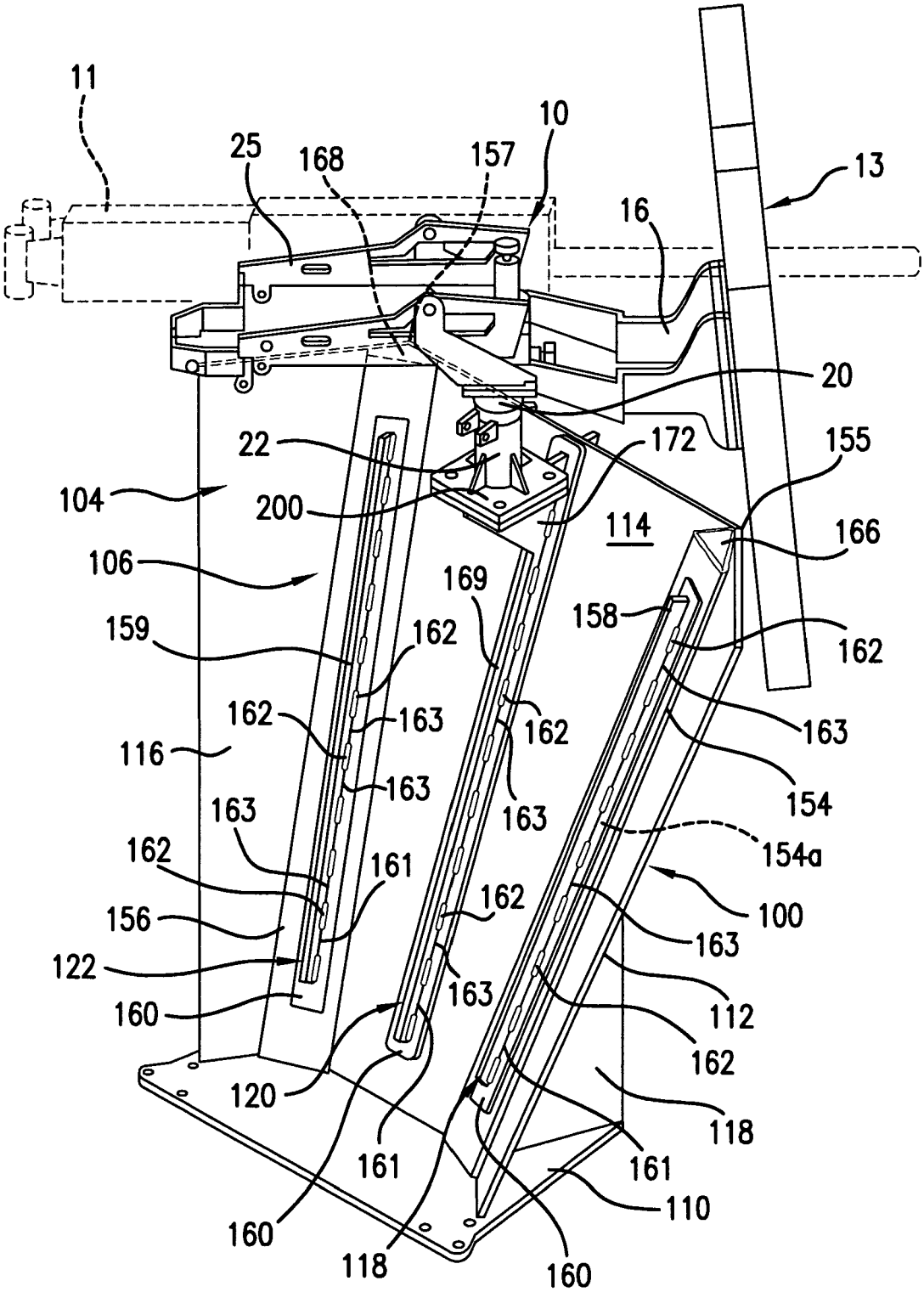
FIG. 3A is a rear perspective view of the fixed weapon emplacement of FIGS. 1 and 2.

FIG. 3B illustrates the welding arrangement for holding the armor plate 154 in place on the strut 118. A similar arrangement holds the armor plate 156 in place on the strut 122. A welding plate is not used in FIG. 2A, but the rear portion 169 of the strut 120 is welded to the weld plate 160 with the same staggered weld stitches 162.

Figure 9:
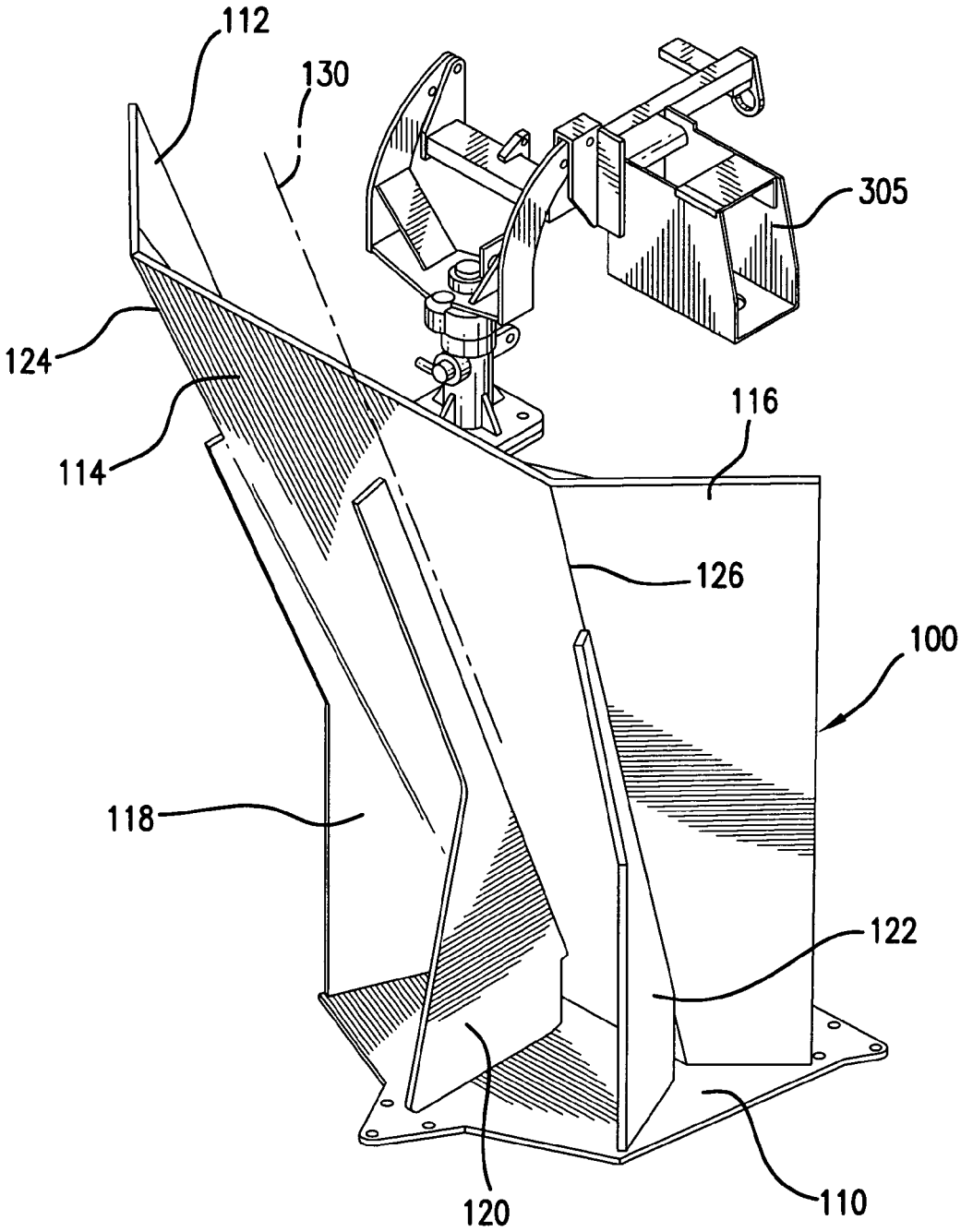
FIG. 9 is a front perspective view of the ballistics stand of FIG. 8.
Figure 10A:
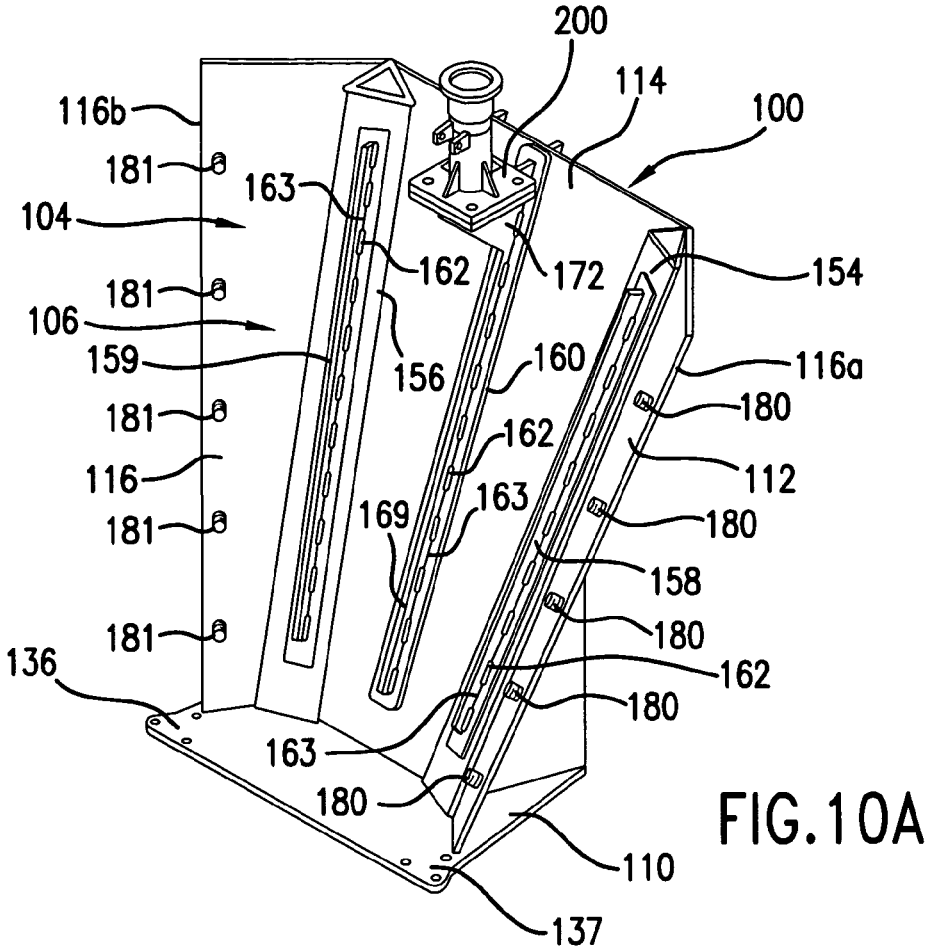
FIG. 10A is a view similar to FIG. 8 of a ballistics stand for mounting a stand such as an MK16 Model 9 stand.
Figure 11:
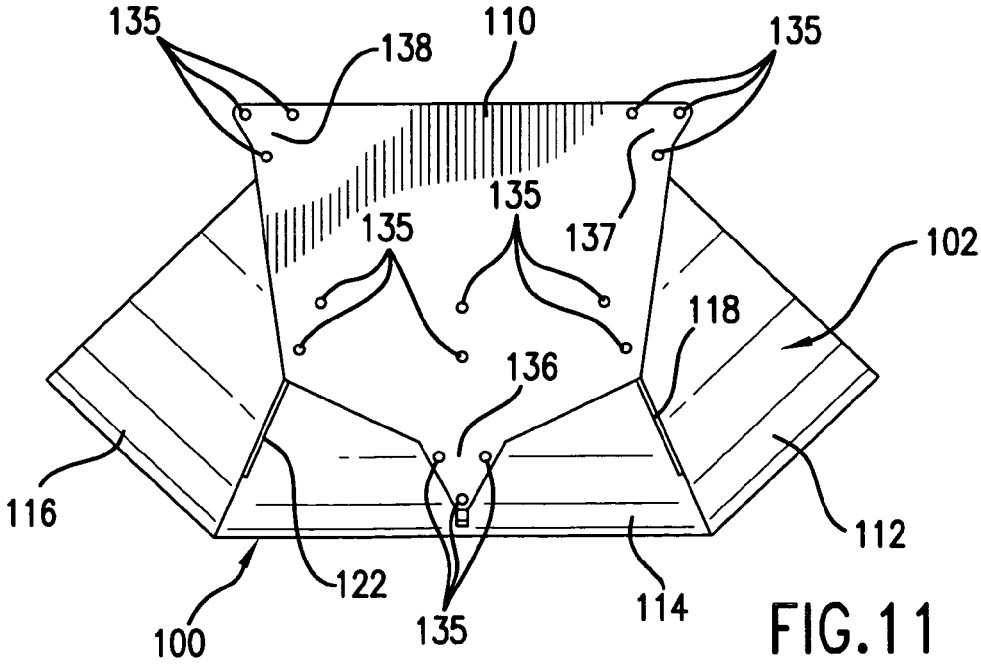
FIG. 11 is a bottom view of the ballistic weapons stand of FIGS. 1–5 and 8–10.
Figure 10B:
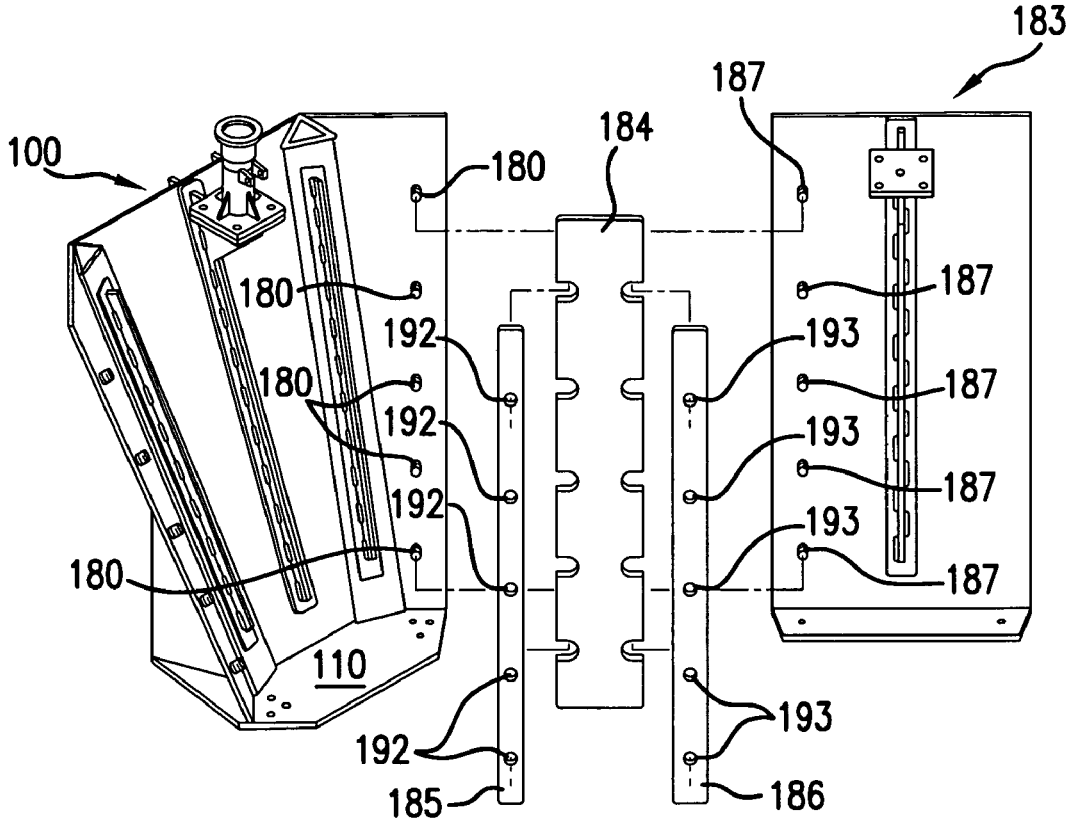
FIG. 10B is a perspective view of the stand of FIG. 10A or a similar stand with an adjacent stand and coupling members to connect stands.
Figure 10C:
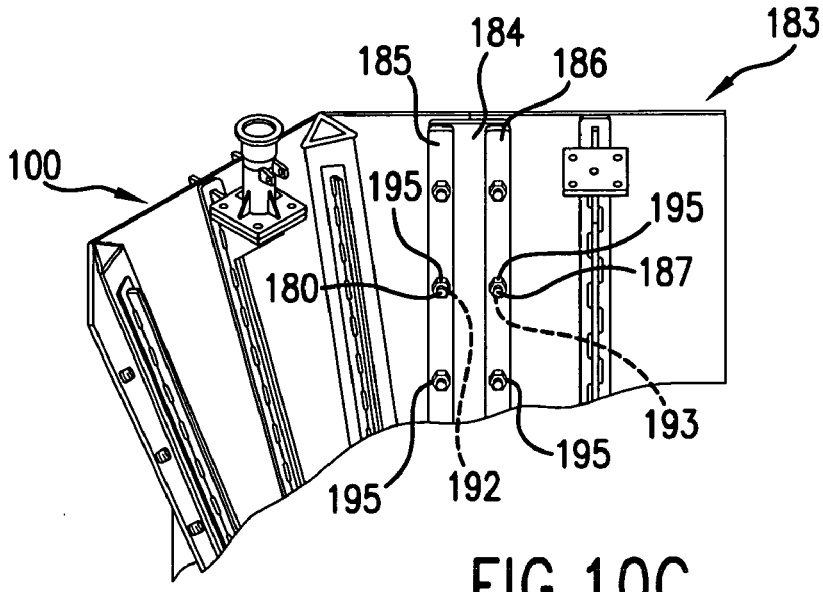
FIG. 10C shows a portion of two stands coupled together.

Referring now to FIGS. 10A, 10B and 10C, the ballistic weapon stand 100 has a first array of threaded studs 180 adjacent an edge 112*b* of the armor panel 112 and a second array of threaded studs 181 along adjacent an edge 116*b* of the armor panel 116. While illustrated only in FIGS. 10A, 10B and 10C, the threaded studs 180 and 181 are also useable on the ballistic weapons stands of FIGS. 1–5, 8, 9, 11 and 13. The threaded studs may either be welded to the armor panels 112 and 116 or may be the shanks of bolts having heads on the front surface of the armor panels.

The threaded studs 180 and 181 are used to fix an adjacent ballistic weapons stand 183 to the ballistic weapon stand 100. This is accomplished by clamping a notched filler armor panel 184 to the armor panel 112 with a clamping strip 185 that fits over the filler panel 184 and the threaded studs 180 and clamping strip 186 that fits over the filler panel 104 and threaded studs 187 projecting from the adjacent ballistic weapons stand 183. The notched filler armor panel 184 has notches 189 along one edge and notches 190 along the opposite edge of the filler panel 184 that receive the threaded studs 180 and 181. The clamping strips 185 and 186 have holes 192 and 193, respectively, that receive the threaded studs 180 and 181. When nuts 195 are threaded on to the threaded studs 180 and 181 and tightened down against the clamping strips 185 and 186, the clamping strips bare down against the notched filler armor panel 184 and press the armor panel 184 against the armor panel 112 and against the armor panel of the ballistic weapon stand 183 to secure the ballistic weapon stands 100 and 183 to one another. The filler armor panel 184 covers the joint between the edges 112*b* of armor panel 112 and edge 183*a* of the armor panel 183.

Figure 13:
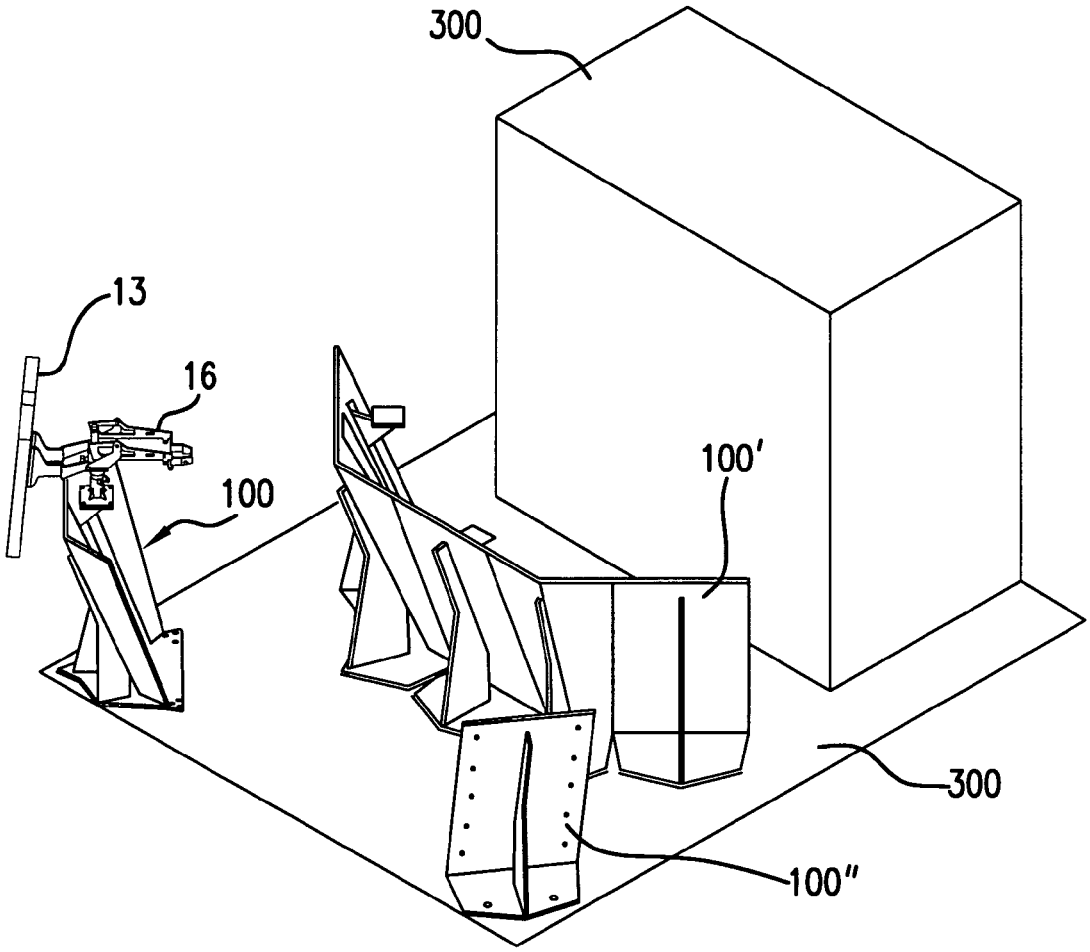
FIG. 13 is a perspective view showing various ballistic weapons stand configurations.

The armor panel 183 has threaded studs 196 on the edge 183*a* thereof so that numerous ballistic weapon stands may be connected (as illustrated in FIG. 13).

Figure 12:
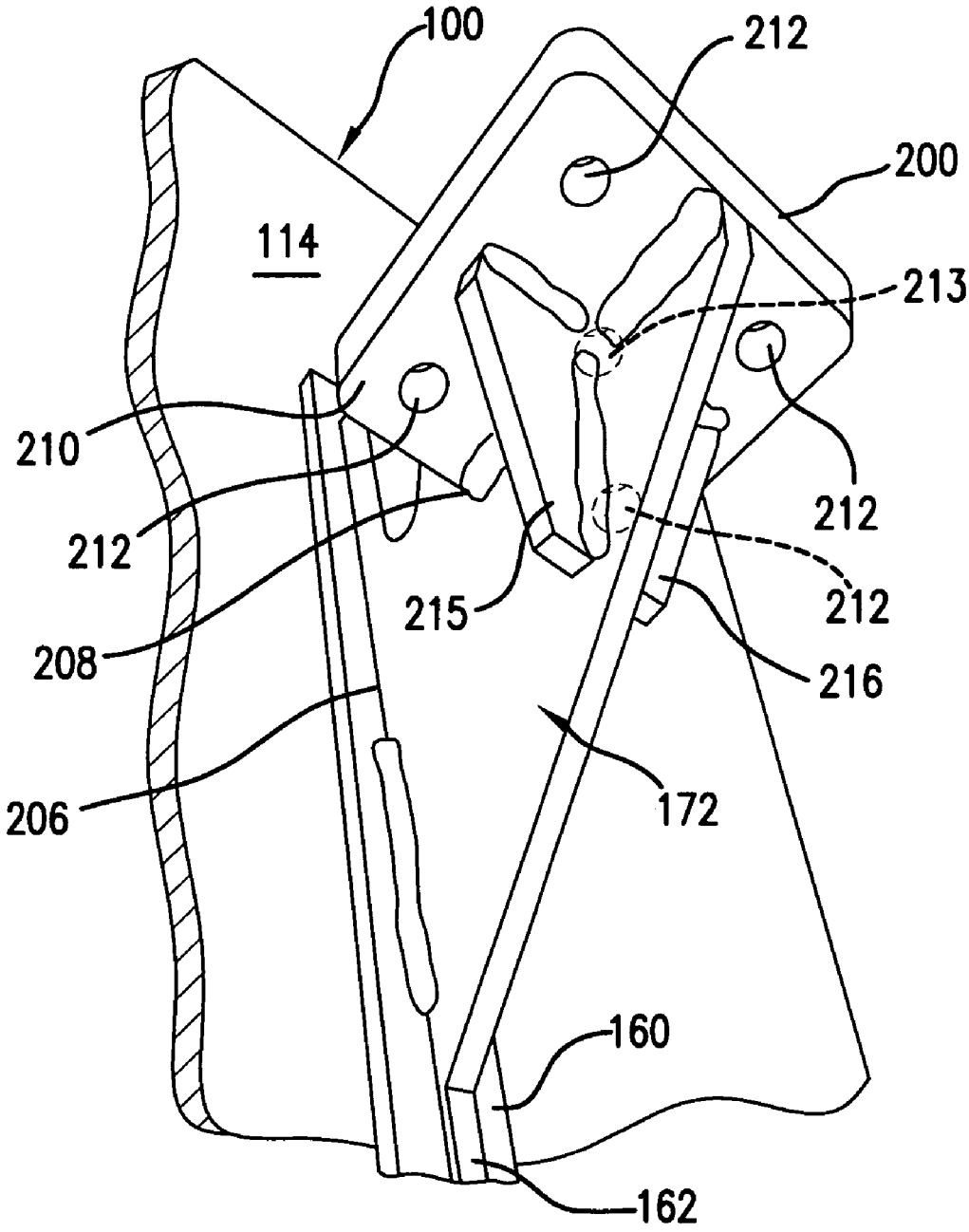
FIG. 12 is a perspective view of a weapon support used with the illustrated ballistic weapons stands.

Referring now to FIG. 12, a platform 200 is supported on the triangular projection 172 which extends from the gusset 120. The triangular projection 172 has a top edge 208 welded to the bottom 210 of platform 200. Four bolt holes 212 are provided in the platform 200 to rigidly couple to the stationary portion 22 of the swivel 20 (see for example FIGS. 1–3) to the platform. A single circular recess 213 is positioned equidistant from the bolt holes 212. The platform 200 is further rigidified by a pair of triangular braces 215 welded to the bottom surface 210 of the platform and to the triangular projection 172. The braces 215 extend perpendicular to the triangular projection 172.

Referring now to FIG. 13, five modular armored security shields including three straight panels and two 2 corner panels (See parent patent application Ser. No. 10/445,776). The straight panels and corner panels can also be connected to ballistic weapon stands 100. Stands 100' and 100" are single MASS straight panel stands described in the parent application. The box 300 represents a guard shack which is being protected. The ballistic weapon stand 100 is configured with a transparent shield 13 while the weapon stands 100' and 100" do not have attached transparent shields. The ballistic stand 100' has a plurality of positions for weapons so that it can be manned by a plurality of gunners having platforms, such as the platform 200 of FIG. 12 to thus provide a plurality of fixed emplacement weapons. The various ballistic weapon stands of FIG. 13 are connected using the techniques of FIGS. 10A, 10B and 10C.

In a preferred embodiment, the transparent panels 40 and 42 each have a surface associated therewith, either externally or internally within a lamination, which transmits images in only one direction, i.e., from the outside into the protected space 106. In other words, to a gunner a possible assailant is visible through the panels 40 and 42 and to an assailant the gunner is not visible. In a preferred embodiment, this is accomplished by a layer 320 (see FIGS. 1 and 7A) on the front or rear surfaces of the transparent panels 40 and 42. The layer 320 in a first embodiment is in the form of a coating on the front or rear surface or one an interior layer of a lamination forming the panels 40 and 42. In a second embodiment the layer is in the form of a film overlying a surface of the transparent panels 40 and 42. In a third embodiment and preferred embodiment, the layer 320 is in the form of plastic panels having a thickness of about 1/16 to 1/8 inch, which are attached over the transparent panels 40 and 42 (See FIG. 7A). In a fourth embodiment the transparent layer is a flexible sheet which is draped over the transparent shield 13 in which the flexible layer has one-way image transmission or is in the form of netting having a weave that does not interfere substantially with the vision of a gunner manning the gun 11.

In order to make the fixed weapon emplacement 10 less apparent to an unfriendly observer, it is preferable to make the transparent material of the panels 40 and 42 non-reflective and to make the layer 320, if used, with a camouflage pattern 322 on the visible surface thereof viewed from in front of the shield 13. The pattern 322 may in other embodiments be any other pattern, such as but not limited to a national flag or even an advertisement. In other embodiments suitable for situations where a gunner might be helped by interfering with the vision of an adversary, the layer 320 could be reflective like a mirror so as to reflect light at the adversary. Such an arrangement might also serve as camouflage since it normally reflects the surrounding terrain.

Figure 8:
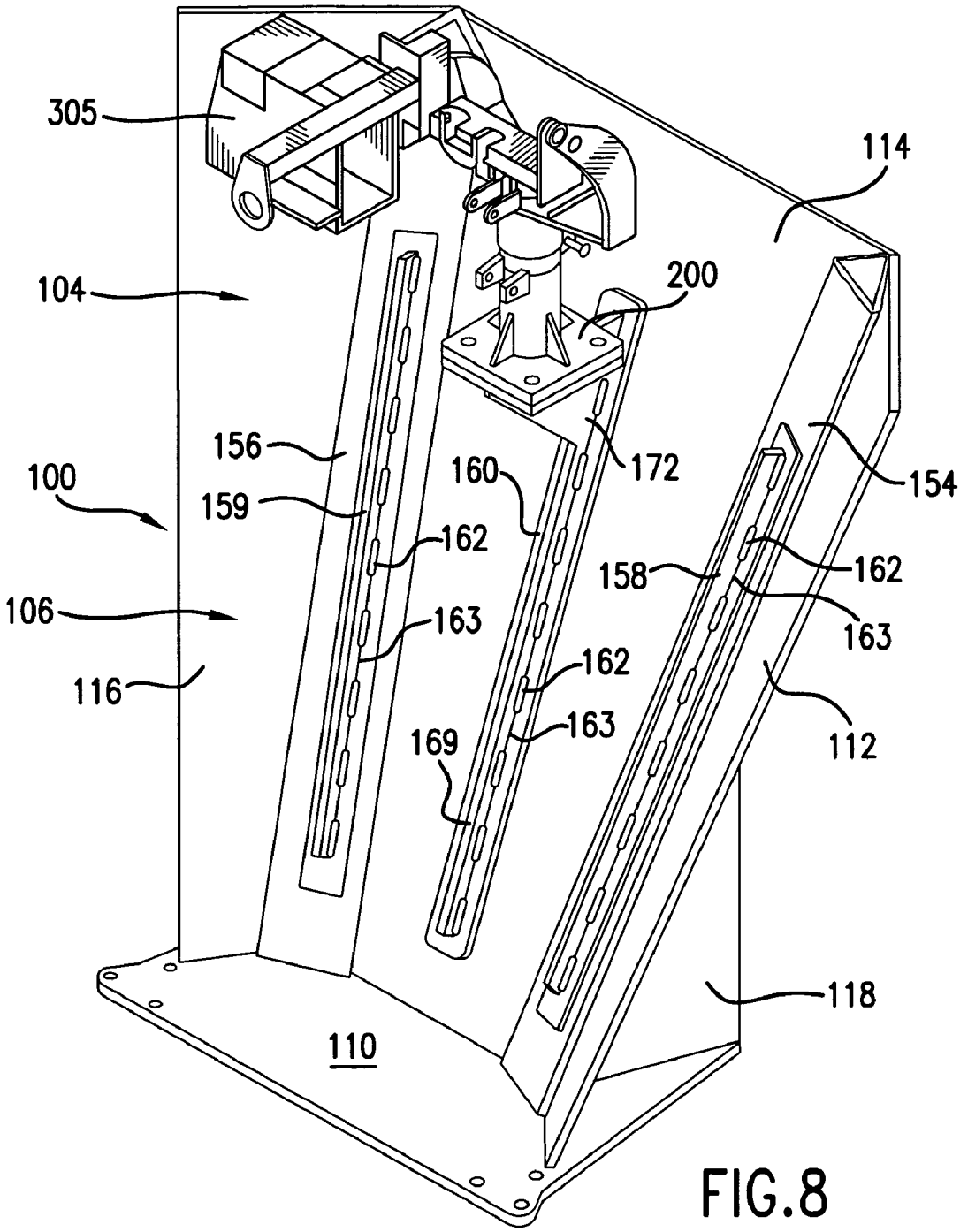
FIG. 8 is a rear perspective view of a protective ballistic stand configured in accordance with the present invention, shown without a transparent shield for mounting a weapons mount or cradle for a weapon such as, but not limited to, a MK93.

In FIGS. 1–5, the mount is configured with a MK93 weapons cradle. In FIGS. 8 and 9, the stand is configured with a MK82 gun mount and includes a magazine 305. In FIG. 10 the mount is used with a MK16 stand. The ballistic weapons stand 100 and transparent shield while very suitable for long guns of practically any description and is suitable for other devices such as mortars. The ballistic weapon stand 100 and fixed weapon emplacement 10 with a transparent shield 13 generally enhances the security of personal, vehicles and other soft and hard assets.

From the foregoing description, one skilled in the art can easily ascertain the essential characteristics of this invention, and without departing form the spirit and scope thereof, can make various changes and modifications of the invention to adapt it to various usages and conditions.

We claim:

1. A projectile resistant transparent shield, comprising:

a base plate of armored material, the base plate having a slot therein for accommodating a barrel of a weapon and having an arrangement proximate the slot for attaching the base plate adjacent to the weapon;

openings through the base plate, the openings being disposed laterally of the slot on opposite sides of the slot;

a panel arrangement of transparent material overlying the openings, the transparent material being resistant to penetration by bullets and shrapnel, and a box frame arrangement in nesting relationship with the panel arrangement and peripherally overlying the panel arrangement to hold the panel arrangement in a fixed relation over the openings through the base plate, the box frame being substantially lighter in weight than the base plate.

2. The projectile resistant transparent shield of claim 1 wherein the panel arrangement comprises first and second panels which overlie the openings through the base plate and wherein the box frame arrangement comprises first and second box frames which peripherally overlie the first and second panels, respectively.

3. The projectile resistant transparent shield of claim 2 wherein the first and second box frames have peripheral flanges with holes therethrough which align with holes in the base plate to receive bolts or rivets which fix the box frames to the base plate.

4. The projectile resistant transparent shield of claim 3 wherein the armored material of the base plate is armored steel and wherein the material of the box frames is steel, the base plate having a thickness substantially greater than the thickness of the box frames.

5. The projectile resistant transparent shield of claim 4 wherein the base plate has a thickness in the range of about 1/4 inch to about 1/2 inch and the thickness of the box frames in a range of 10 to 15 gauge.

* * * * *